United States Patent [19]

Ostmann

[11] 4,299,666

[45] Nov. 10, 1981

[54] HEATING WALL CONSTRUCTION FOR HORIZONTAL CHAMBER COKE OVENS

[75] Inventor: August Ostmann, Händelstrasse 31, 4350 Recklinghausen, Fed. Rep. of Germany

[73] Assignee: Firma Carl Still GmbH & Co. KG, Fed. Rep. of Germany

[21] Appl. No.: 135,111

[22] Filed: Mar. 28, 1980

[30] Foreign Application Priority Data

Apr. 10, 1979 [DE] Fed. Rep. of Germany ..... 2914387

[51] Int. Cl.[3] ..... C10B 5/02; C10B 23/00; C10B 29/02

[52] U.S. Cl. ..... 202/267 R; 202/139; 202/223

[58] Field of Search ..... 202/139, 141, 142, 143, 202/144, 223, 267 R, 126, 114; 165/106; 432/223, 247, 249

[56] References Cited

U.S. PATENT DOCUMENTS

| | | | |
|---|---|---|---|
| 1,989,459 | 1/1935 | Parker | 202/223 X |
| 2,141,035 | 12/1938 | Daniels | 202/223 |
| 2,564,140 | 8/1951 | Wethly | 202/223 X |
| 3,102,846 | 9/1963 | Tucker, Jr. | 202/223 X |
| 3,359,184 | 12/1967 | Thiersch et al. | 202/223 |
| 3,809,620 | 5/1974 | Wackerbarth et al. | 202/267 R X |
| 4,196,052 | 4/1980 | Szurman et al. | 202/267 R X |

*Primary Examiner*—Bradley Garris

*Attorney, Agent, or Firm*—McGlew and Tuttle

[57] ABSTRACT

A heating wall construction for horizontal chamber coke ovens comprises spaced apart stretcher stone walls with header walls extending therebetween and being spaced from each other to define vertical heating flues therebetween. The header walls are hollow or have a hollow portion which defines a vertical heating flue for their fuel supply and they have transfer slots in the walls which connect at various levels for transferring the heating gases from the hollow central portion to the flues. The runner stones of the heating walls have a thickness of less than 110 mm and the hollow headers are over 200 mm wide at their widest point in the central region of the heating flue and they are much wider than 100 mm at their abutting or tie in point in the stretcher stone walls.

5 Claims, 2 Drawing Figures

FIG. 1
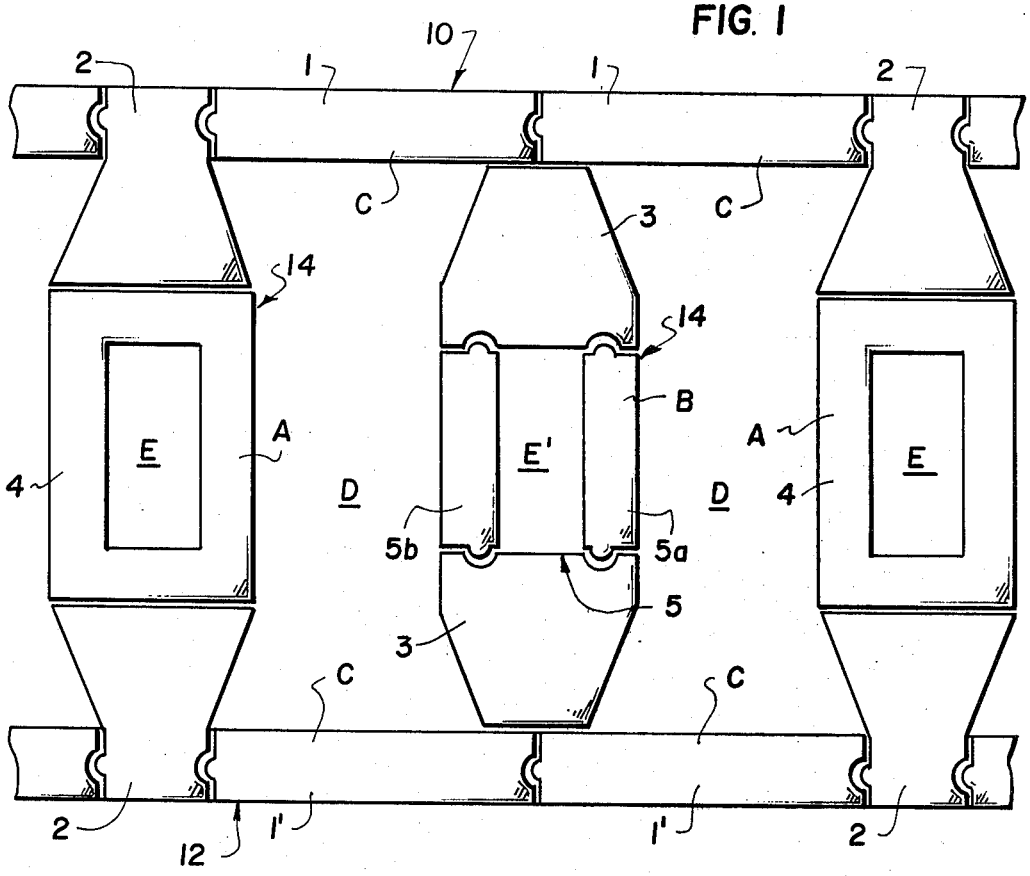
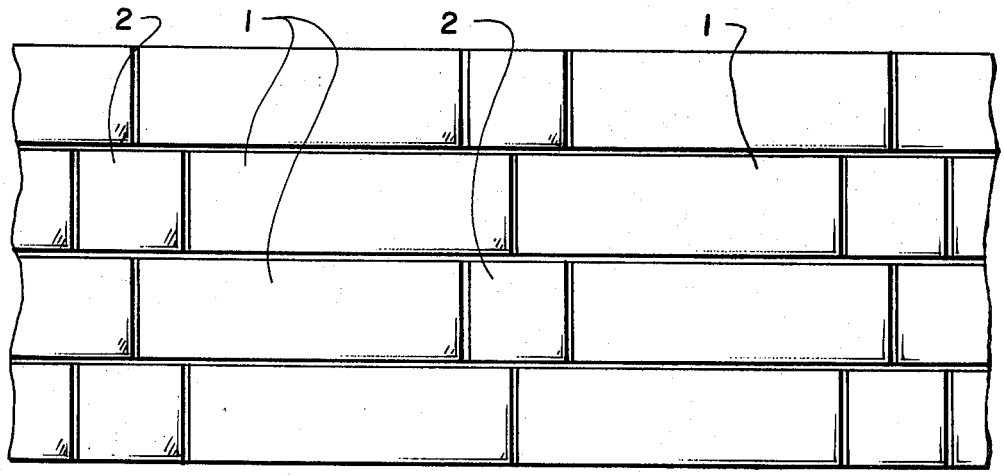
FIG. 2

HEATING WALL CONSTRUCTION FOR HORIZONTAL CHAMBER COKE OVENS

FIELD AND BACKGROUND OF THE INVENTION

The invention relates in general to coke ovens and in particular to a new and useful heating wall construction for horizontal-chamber coke ovens which are subdivided into vertical heating flues and where vertical channels are provided in the header walls of the heating flues for the fuel supply (lean gas and air), as well as transfer slots into the heating flues where the stretcher stones of the heating walls have a thickness of less then 110 mm.

Known is a horizontal coke oven with heating walls divided into vertical heating flues and a thickness of the stretcher stones under 110 mm, where the thickness of the headers does not exceed 100 mm. With a thickness of the stretcher stones between 60 and 80 mm, the headers have a thickness between 70 and 90 mm, and the heating flue cross walls, hence the headers, can be so designed in a different embodiment that they decrease constantly, or in steps, to a maximum thickness of 100 mm before they are tied into the stretcher stones. (see German Patent No. 2,161,980 or U.S. Pat. No. 3,809,620).

The advantages of heating walls made of thin stretcher stones are sufficiently known so that they need not be discussed in this connection. But the stretcher stones of the heating walls must not be made too thin because the gas tightness and the strength of the structure must be ensured. Beyond that, the manufacture of the stone becomes more difficult with decreasing thickness.

The constant or stepwise decrease of the thickness of the headers to 100 mm and less at the point where they butt against or are tied into the stretcher stones of the heating wall, should be effected in view of the fact that it is not longer possible to operate modern coloring plants with oven chamber heights of 6 meters and more without heating at several levels, and it is advisable for the supply of the fuel to the heating flues to provide feed channels in the heating flue headers, as has been done previously.

The supply of the gaseous fuel to the heating flue of 6 meters height and more required channel cross sections which cannot be accommodated in headers with a thickness of little over 100 mm, rather these headers have at their widest point a thickness of over 200 mm. Channels with a sufficient cross section for the gas currents can then be provided in the headers and it is also possible to provide the lateral parts of the headers with sufficient material thickness so that the entire structure of heating walls, header walls and oven roof, which rests on the regenerator, with the associated supports and reinforcements has the necessary strength to withstand loads during the operation, e.g. by the heavy hopper car on the battery cover.

The width and thickness respectively of the headers, namely the parts which are tied into the stretcher stones of the heating wall, or which butt against them, are kept low, because the heat transfer to the heating wall is reduced there and "dark stripes" are found on the oven chamber side of the heating wall under certain circumstances when there is an increasing thickness of these parts and heating from the base of the flue. These stripes indicate the course of the headers based on the reduced heating.

SUMMARY OF THE INVENTION

According to the present invention, a horizontal coke oven is provided with heating walls which are subdivided into vertically extending heating flues by header walls composed of stone forms dimensioned so that the heat transfer through the heating wall is not adversely influenced. The hollow headers are constructed so that they are, at their widest point in the center range of the heating flue, over 200 mm, and much wider than 100 mm at the point where they butt against or are tied into the stretcher stones of the heating wall.

Preferably the tie-in or butting points of the header tops have widths of 110 to 120 mm.

It was found surprisingly that in the design of the headers according to the invention where the hollow headers include transfer slots for the fuel into the heating flues which are distributed over the height of the header channels, the slots carrying air in the case of rich gas heating and air and/or lean gas in the case of lean gas heating, no "dark stripes" appear on the chamber side of the heating wall at the tie-in or butting points, even with such widths and thicknesses of the headers.

It is assumed that this is due to the fact that the radiation of the heat to the stretcher stones of the heating wall is on the whole more favorable with the combustion points distributed over the height, than if only a single combustion point is arranged at the bottom, and perhaps a second one slightly higher in the heating flue, so that a relatively good heat transfer is achieved beyond the butting- and tie-in points of the headers to the heating walls, and the "dark or black stripes" do not appear.

It is particularly advantageous to design the new heating wall according to West German Patent No. 1,421,285 (corresponding to U.S. Pat. No. 3,359,184), that is, the header walls comprise central and top stones which are partly narrower than the central stones and which interlock with the stretcher stones by means of a tongue and groove joint and where a first type of stone layers are provided for the header walls, and the top stones which extend through the stretcher walls are connected by the stone layer down to the coal touched heating surface. In addition, a second type of stone layers is provided for the header walls, where the adjacent stretcher wall remains uninterrupted and alternate both in the horizontal and in the vertical in such a way that a stone layer of the first type is followed by a stone layer of the second type, and where both top stones of the second type of stone layers for the header walls abut on the stretchers and the central stone is designed as a hollow stone, while the central stones of the stone layers of the second type are composed of edge stones between which a hollow space remains.

The length of a stetcher stone extends preferably from the center line of a header butting against the stretcher wall up to the top stone of the adjacent header and this stretcher stone is provided on a length side and an end face with a longitudinally extending groove, as well as on the opposite length side and the opposite end face with a tongue fitting into the groove.

The surfaces of the top stones abutting on the stretcher walls can also be provided with vertical grooves to be filled with mortar.

According to the invention it is thus possible to build a durable heating wall of thin stretcher stones and rugged header stones, which permit a uniform and good heat transfer to the length of the heating wall, hence also to the abutting- and tie-in points of the headers.

Accordingly it is an object of the invention to provide a heating wall construction for horizontal chamber coke ovens which comprise spaced apart first and second stretcher walls and a plurality of header walls extending between the stretcher walls at spaced locations and defining vertical heating flues therebetween, the header walls having a hollow portion defining a vertical heating flue for the fuel supply and having transfer slots in the walls, said heating walls having stretcher stones with a thickness of less than 110 mm and the hollow headers being over 200 mm wide at their widest point in the central region of the heating flues and much wider than 100 mm at their abutting or tie-in point into the stretcher walls.

In accordance with the invention, an improved heating wall construction is provided for a coke oven of the type having a plurality of horizontally spaced coke oven chambers separated by spaced apart vertically extending heating walls, each heating wall being divided into a plurality of vertically extending heating flues. Each heating wall is formed of spaced apart first and second stretcher stone walls and a plurality of horizontally spaced header walls extending between the stretcher stone walls of adjacent oven chambers to divide the space between adjacent header walls and stretcher stone walls into the vertically extending heating flues. Each of the header walls includes a vertically extending hollow central portion defining a fuel supply space. Each of the header walls is composed of a plurality of vertically stacked headers comprising first headers having opposite tie-in ends extending into respective stretcher stone walls to the coal contacted surface thereof and second headers alternating vertically with the first headers and having opposite abutting ends abutting the interior of the respective stretcher stone walls. The width of each header wall, at the center thereof intermediate the stretcher stone walls, is substantially greater than the width of the header wall adjacent the stretcher stone walls. The header walls have transfer slots therein connecting the fuel supply space and an adjacent heating flue. Each of the stretcher stones has a thickness of less than 110 mm. in the direction of heat transfer extending from the heating flues toward the oven chambers. In accordance with the improved arrangement of the invention, the width of each of the header walls is greater than 200 mm wide at its widest point and the ends of the headers at their abutting and tie-in ends are wider than 100 mm.

A further object of the invention is to provide a heating wall construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 1 is a partial plan view of the stone layer of a heating wall constructed in accordance with the invention; and FIG. 2 is a partial side elevational view of the construction shown in FIG. 1.

DETAILED DESCRIPTION OF THE PREFERRED EMBODIMENTS

Referring to the drawings in particular, the invention embodied therein comprises a heating wall construction for horizontal chamber coke ovens which comprise spaced apart stretcher stone walls generally designated 10 and 12 with a plurality of header walls 14 extending between the stretcher walls and dividing the space between the adjacent header walls and the stretcher walls into vertical heating flues D.

The heating wall contains in known manner so-called header walls 14 with two different alternately arranged stone layers A and B, which alternate in a vertical direction from stone layer to stone layer, and also in horizontal direction from one header wall to the other. The header walls extend transverse to the longitudinal direction of the chamber and connect the two opposite stretcher stone walls C of a heating wall, where the header tops 2 of stone layers A are inserted into stretcher stones 1 up to the opposite surface or so-called coal-touched surface, and header tops 3 of stone layer B abut on the inside of stretcher stones 1. As shown in FIG. 1, header stone layer A is composed of three parts, and has two outer header top stones 2 tapering conically toward stretcher stones 1, and a central hollow stone 4 with a rectangular hollow space E for the supply of the fuel from the regenerators arranged under the heating walls to the combustion chambers, the heating flues D.

The heating flue D comprises the space which is enclosed by stretcher stone walls C and between two header walls with the alternating stone layers A and B. The figures do not show the rich gas supply nozzles at the base of the heating flues and the feed slots from the hollow spaces E and E' of headers 4 and 5 to the heating flues D and which are arranged at different levels. Header stone layer B is arranged both above and below a stone layer A. The central part is substantially shortened and consists of two separate edge stones **5*a* and 5*b*, which together with header top stones 3 form the header 5 and the rectangular cavity E'. Header top stones 3 do not engage the stone units 1 and 1', but only abut on them. In accordance with the invention, the tie-in ends of header top 2 and/or the abutting ends of header top 3** of the header walls preferably have widths of from 110 to 120 mm and the stretcher stones preferably have widths of from 70 to 85 mm.

In the two figures, the dimensions of the various stone forms are represented substantially according to scale. With a thickness of stretcher stones 1 and 1' being 85 mm, the width of the header top stones 2 and 3 at the transition point to the stretcher stones is 120 mm. With a coke oven chamber of about 6 m height, hollow headers 4 and 5 have in the central region of the heating flues a width of 240 mm, which decreases over the height of the heating flue with cavity cross sections E and E' diminishing at the top. The total width of the heating wall and the total length of the header stone layer A can vary between 850 and 1000 mm. With a mean distance between the hollow header stones of 460 mm, the inside width of a heating flue widens from the inside to the outside in the construction according to the invention by 100 mm. Despite a substantial reinforcement of header top stones 2 and 3 at the tie-in point into stretcher stones 1, compared to the suggestion in German Patent No. 2,161,980, the surface at the coal-touched wall of the heating flue is still so large that a uniform heat passage up to the coal is insured, with simultaneous utilization of the advantage of a low stretcher stone thickness.

While specific embodiments of the invention have been shown and described in detail to illustrate the application of the principles of the invention, it will be understood that the invention may be embodied otherwise without departing from such principles.

What is claimed is:

1. An improved heating wall construction for a coke oven of the type having a plurality of horizontally spaced coke oven chambers separated by spaced-apart vertically extending heating walls, each heating wall being divided into a plurality of vertically extending flues, each heating wall being formed of spaced apart first and second stretcher stone walls, a plurality of horizontally spaced header walls extending between the stretcher stone walls of adjacent oven chambers to divide the space between adjacent header walls and the stretcher stone walls into the vertically extending heating flues, each of the header walls having a vertically extending hollow central portion defining a fuel supply space and comprising a plurality of vertically stacked headers including first headers having opposite tie-in ends extending into respective stretcher stone walls to the coal contacted surface thereof and second headers alternating vertically with the first headers and having opposite abutting ends abutting the interior of the respective stretcher stone walls, the width of each header wall, at the center thereof intermediate the stretcher stone walls, being substantially greater than the width of the header walls adjacent the stretcher stone walls, said header walls having transfer slots therein connecting the fuel supply space and an adjacent heating flue, each of the stretcher stones having a thickness of less than 110 mm in the direction of heat transfer extending from the heating flues toward the oven chamber, the improvement wherein the width of each of the header walls is greater than 200 mm wide at the widest point thereof and the ends of the headers at their abutting and tie-in ends is wider than 100 mm.

2. A heating wall construction according to claim 1, wherein said tie-in ends and said abutting ends of said header walls have widths of from 110 to 120 mm.

3. A heating wall construction according to claim 2, wherein said stretcher stones have widths of from 70 to 85 mm.

4. A heating wall construction according to claim 3, wherein said first headers comprise a central hollow stone portion with an opening therethrough and having a header stone at each end of said central portion tapering outwardly toward the adjacent respective stretcher stone wall.

5. A heating wall construction according to claim 4, wherein each of said abutting ends of the second headers have flat ends abutting against the stretcher stone walls which tapers outwardly from the ends to the central portion thereof, and the second headers comprise spaced apart header tops with spaced apart stone members extending between said header tops.

* * * * *